US006682816B1

(12) United States Patent
Wang

(10) Patent No.: US 6,682,816 B1
(45) Date of Patent: Jan. 27, 2004

(54) FISHING LINE AND METHOD FOR MAKING THE SAME

(75) Inventor: Tsan-Ching Wang, Changhua (TW)

(73) Assignee: Yao I Fabric Co., Ltd., Changhua (TW)

( * ) Notice: Subject to any disclaimer, the term of this patent is extended or adjusted under 35 U.S.C. 154(b) by 0 days.

(21) Appl. No.: 10/207,046

(22) Filed: Jul. 30, 2002

(51) Int. Cl.[7] ..... D02G 3/00

(52) U.S. Cl. ..... 428/373; 428/375; 428/378; 428/395

(58) Field of Search ..... 428/375, 373, 428/395, 378

(56) References Cited

U.S. PATENT DOCUMENTS 5,354,616 A * 10/1994 Fish et al. ..... 428/373
5,573,850 A * 11/1996 Cunningham et al. ..... 428/373
2003/0082381 A1 * 5/2003 Nakanishi ..... 428/375

* cited by examiner

*Primary Examiner*—Cynthia H. Kelly
*Assistant Examiner*—J. M. Gray
(74) *Attorney, Agent, or Firm*—Rosenberg, Klein & Lee

(57) ABSTRACT

A fishing line includes a core portion composed of multiple Polyethylene wires and a coating is mounted to the core portion and combines the Polyethylene wires together. The coating is a mixture of Polyethylene having low fusing point, silicon resin and powder of hexamethylenebis-3-(3, 5-ditertiarybutyl-4-hydroxyphenyl) propionamide. The Polyethylene is melted and the mixture is extruded to combine the Polyethylene wires. The coating is then cooled to solidify.

3 Claims, 3 Drawing Sheets

FISHING LINE AND METHOD FOR MAKING THE SAME

FIELD OF THE INVENTION

The present invention relates to a fishing line and a method for making the fishing line which is composed of multiple Polyethylene wires and coated by a mixture of Polyethylene, silicon resin and hexamethylenebis-3-(3,5-ditertiarybutyl-4-hydroxyphenyl) propionamide.

BACKGROUND OF THE INVENTION

A conventional fishing line is required to have several features such as durable for friction, flexibility and light in weight. It is difficult to find a fishing line having all the important characters mentioned above.

The present invention intends to provide a fishing line that reaches the above goals and a method for making the fishing line.

SUMMARY OF THE INVENTION

In accordance with one aspect of the present invention, there is provided a fishing line which comprises a core portion which is composed of multiple Polyethylene wires and a coating on an outside of the core portion. The coating is a mixture of Polyethylene having low fusing point, silicon resin and powder of hexamethylenebis-3-(3,5-ditertiarybutyl-4-hydroxyphenyl) propionamide.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
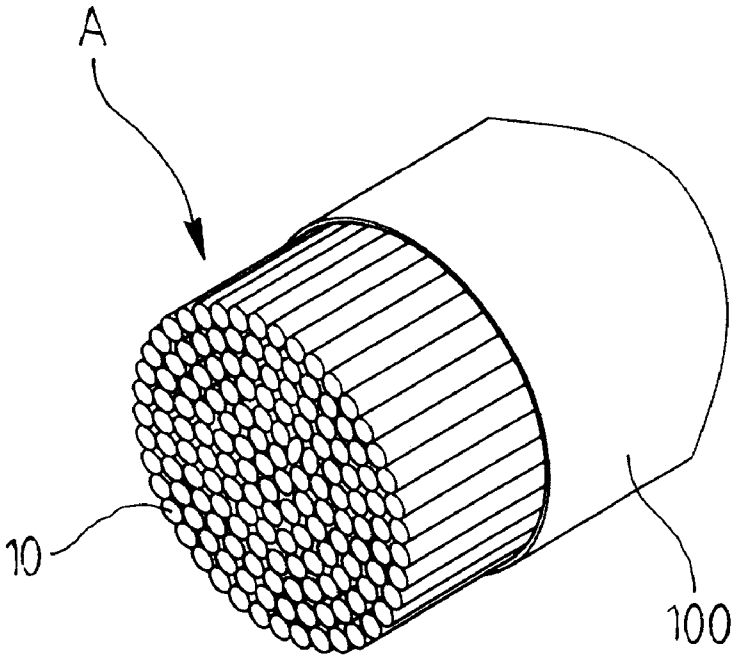
FIG. 1 is a perspective view to show the fishing line of the present invention.
Figure 2:
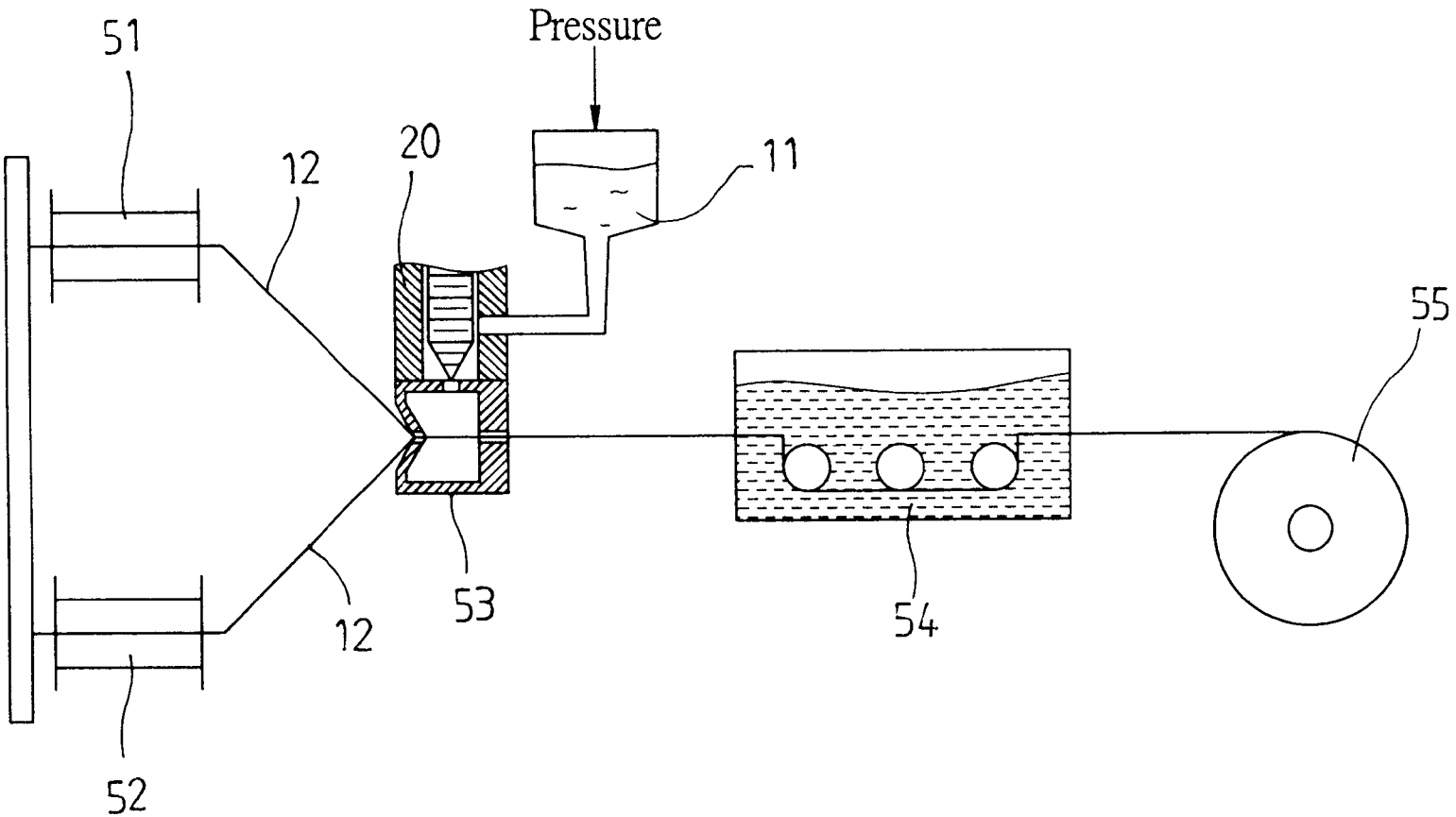
FIG. 2 shows the how the fishing line is made.

Referring to FIGS. 1 and 2, the fishing line "A" of the present invention comprises a core portion which is composed of multiple Polyethylene wires and a coating 100 wraps around the core, portion. The coating 100 is a mixture 11 of Polyethylene having low fusing point, silicon resin and powder of hexamethylenebis-3-(3,5-ditertiarybutyl-4-hydroxyphenyl) propionamide. The fusion point of the Polyethylene is 130 to 150 degrees Celsius and the mixture 11 includes 95% to 99% of Polyethylene with low fusion point, 1% to 5% of silicone resin and 0.1% to 0.3% of an agent comprising hexamethylenebis-3-(3,5-ditertiarybutyl-4-hydroxyphenyl) propionamide. The Polyethylene with low fusing point is melted and pressurized to combine the Polyethylene fishing lines by an extruder 20. The coating 100 is then cooled into clod water and solidified so as to have a better durable feature and water-proof feature.

Figure 3:
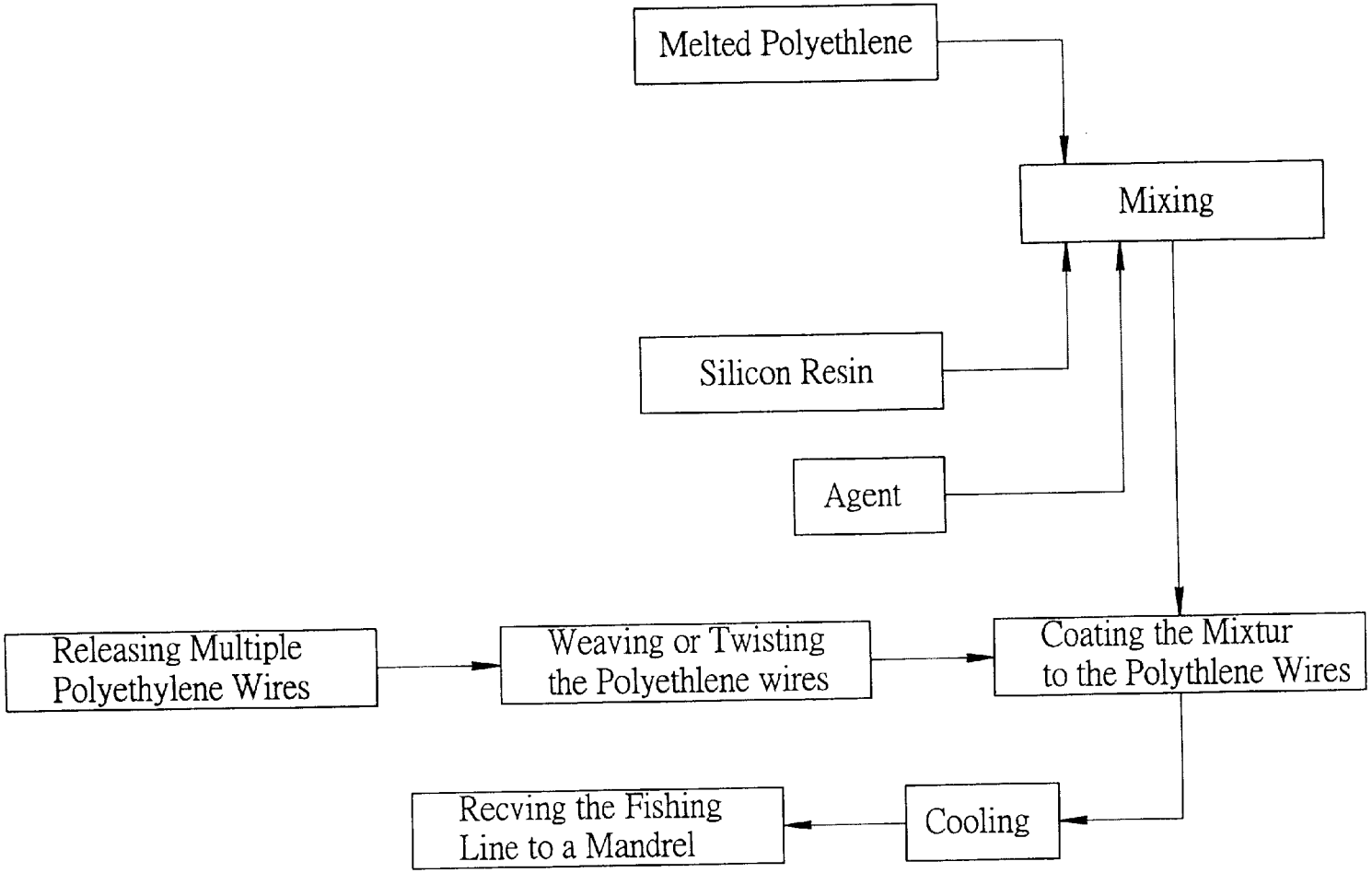
FIG. 3 shows the manufacturing processes of the method for making the fishing line.

FIGS. 2 and 3 shows the steps of the method for making the fishing line "A" and includes the following steps:

step (1): releasing multiple Polyethylene wires 12 from mandrels 51, 52 and the Polyethylene wires 12 being arranged into a core portion 10, the core portion 10 being coated with a coating 100 which is composed of a mixture 11 having low fusion point, the mixture being melted and extruded by an extruder 20 at the pressure of the extruder is 20 to 30 kg/cm$^3$ to combine the Polyethylene wires 12;

step (2): the core portion 10 together with the coating 100 passing a cooling device 54 to solidify the coating 100, the cooling device 54 including water having temperature between 5 to 10 degrees Celsius; and step (3): receiving the cooled fishing line of step (2) to a mandrel (55).

The Polyethylene wires 12 can be collected by way of weaving or twisting to form the core portion 10. The coating 100 is durable, flexible and has higher friction efficiency.

The following charts show the comparison between conventional fishing line that has no coating and the fishing line with coating of the present invention;

1. Line Strength

| | line strength (kg, without coating) | g/d | line strength (kg, with coating) | g/d |
|---|---|---|---|---|
| 250 Diner | 6.9 | 27.60 | 7.69 | 30.76 |
| 300 Diner | 8.15 | 27.17 | 9.06 | 30.20 |
| 350 Diner | 7.7 | 22.00 | 9.45 | 27.00 |

2. Tie Strength

| | tie strength (kg, without coating) | g/d | tie strength (kg, with coating) | g/d |
|---|---|---|---|---|
| 250 Diner | 2.56 | 10.24 | 2.78 | 11.12 |
| 300 Diner | 2.89 | 9.63 | 2.92 | 9.73 |
| 350 Diner | 3.11 | 8.89 | 3.17 | 9.06 |

3. Extension Rate

| | extension rate (%, without coating) | extension rate (%, with coating) |
|---|---|---|
| 250 Diner | 3.59 | 3.59 |
| 300 Diner | 4.02 | 3.89 |
| 350 Diner | 4.29 | 3.73 |

4. Durable Test: by loading 150 g and sanding with #120 sand paper

| | times of sanding (without coating) | times of sanding (with coating) |
|---|---|---|
| 250 Diner | 1–5 | 17–21 |
| 300 Diner | 4–6 | 23–27 |
| 350 Diner | 6–8 | 29–32 |

5. Water Absorption Test: by immersing the test item into water 12 for hours and obtaining the weight (X), the rate of water absorption = X-10)/10

| | rate of water absorption (%, without coating) | rate of water absorption (%, with coating) |
|---|---|---|
| 250 Diner | 2–3 | 0.5–1 |
| 300 Diner | 2–3 | 0.5–1 |
| 350 Diner | 5–6 | 0.5–1 |

The fishing line of the present invention is proven to meet the requirements of the modern fishing line from the above charts.

While we have shown and described the embodiment in accordance with the present invention, it should be clear to those skilled in the art that further embodiments may be made without departing from the scope of the present invention.

What is claimed is:

1. A fishing line comprising:

a core portion which is composed of multiple polyethylene wires;

a coating which is a mixture of polyethylene having low fusing point, silicon resin and powder of -hexamethylenebis-3-(3,5-ditertiarybutyl-4-hydroxyphenyl.

2. The fishing line as claimed in claim 1, wherein the fusion point of the polyethylene is 130 to 150 degrees Celsius.

3. The fishing line as claimed in claim 1, wherein the mixture includes 95% to 99% of polyethylene with low fusion point, 1% to 5% of silicone resin and 0.1% to 0.3% of hexamethylenebis-3-(3,5-ditertiarybutyl-4-hydroxyphenyl propionamide.

* * * * *